US012773023B2

(12) United States Patent
Francis

(10) Patent No.: US 12,773,023 B2
(45) Date of Patent: Oct. 27, 2026

(54) KNEEPAD ADAPTED FOR WORKING ON INCLINED SURFACES

(71) Applicant: 9239-9104 QUEBEC INC., Rimouski (CA)

(72) Inventor: Karol Francis, Rimouski (CA)

(73) Assignee: 9239-9104 QUEBEC INC., Rimouski (CA)

( * ) Notice: Subject to any disclaimer, the term of this patent is extended or adjusted under 35 U.S.C. 154(b) by 28 days.

(21) Appl. No.: 18/382,610

(22) Filed: Oct. 23, 2023

(65) Prior Publication Data

US 2024/0130449 A1 Apr. 25, 2024
US 2024/0225145 A9 Jul. 11, 2024

Related U.S. Application Data

(60) Provisional application No. 63/380,450, filed on Oct. 21, 2022.

(51) Int. Cl.
*A41D 13/06* (2006.01)
*E04D 15/00* (2006.01)

(52) U.S. Cl.
CPC ..... *A41D 13/065* (2013.01); *E04D 15/00* (2013.01)

(58) Field of Classification Search
CPC ..... A41D 13/065; A41D 17/00; E04D 15/00
See application file for complete search history.

(56) References Cited

U.S. PATENT DOCUMENTS 1,560,825 A 11/1925 Ludwig
1,753,055 A 4/1930 Roy
1,789,798 A * 1/1931 Wineland ..... E04D 15/00 2/24
2,185,456 A * 1/1940 Cheney ..... A41D 17/00 36/2 R
2,344,415 A * 3/1944 Ryan ..... A41D 17/00 36/2 R
5,727,334 A 3/1998 Cougar
D398,820 S 9/1998 Cougar
(Continued)

FOREIGN PATENT DOCUMENTS

CA 2570797 6/2008

OTHER PUBLICATIONS

Irwin 10503832 Professional Swivel-Flex Knee Pads, available at https://www.powertoolworld.co.uk/irwin-10503832-professional-swivel-flex-knee-pads (last accessed Feb. 7, 2024).

*Primary Examiner* — Katharine G Kane
(74) *Attorney, Agent, or Firm* — Jean-Francois Journault; ROBIC; Eric B. Fugett

(57) ABSTRACT

A kneepad adapted to be worn on a wearer's leg for working on an inclined work surface at various working angles. A pad defines an open cavity for receiving the knee of the wearer, and a contacting interface for adhering to the inclined work surface is secured to the pad. A leg connector is connected to the body of the kneepad and securable to a knee region of the wearer's leg, the leg connector being adapted to abut the pad against the knee. A foot connector is connected to the body of the kneepad and securable to a foot region of the wearer's leg, the foot connector extending from the body of the kneepad to the foot region along the wearer's leg. The foot connector is load-bearing to refrain the body from sliding up the wearer's leg when a force is applied along the wearer's leg.

20 Claims, 11 Drawing Sheets

(56) References Cited

U.S. PATENT DOCUMENTS 5,870,774 A * 2/1999 Legenstein ..... A41D 13/0568 2/24
5,970,525 A 10/1999 Gallinot
5,996,252 A 12/1999 Cougar
6,216,819 B1 4/2001 Cougar
6,219,845 B1 4/2001 Ferriter
6,256,787 B1 * 7/2001 Tyler ..... A41D 13/0568 2/22
6,637,034 B1 * 10/2003 Worden ..... A41D 13/065 2/24
6,802,080 B2 * 10/2004 Hawley ..... A41D 13/065 2/22
6,845,515 B2 1/2005 Sveilich
7,194,770 B1 * 3/2007 Fecenko ..... A41D 1/06 2/227
7,197,770 B1 4/2007 Warren
7,681,248 B2 3/2010 Legenstein
7,735,148 B1 6/2010 Turman
9,210,959 B1 * 12/2015 Jankowski ..... A41D 27/08
9,961,948 B2 5/2018 Archuleta
10,441,007 B2 10/2019 Richards
10,661,150 B1 5/2020 Simpson
12,137,758 B1 * 11/2024 Fehr ..... A41D 13/065
2009/0151039 A1 * 6/2009 Kielland ..... A41D 13/065 2/24
2010/0107291 A1 5/2010 Carter
2014/0082813 A1 * 3/2014 Fullen ..... A41D 27/12 2/46
2014/0182041 A1 * 7/2014 Archuleta ..... A41D 13/065 2/24
2017/0119068 A1 5/2017 Beckenholdt
2019/0231003 A1 * 8/2019 Morris ..... A41D 13/065
2020/0037681 A1 * 2/2020 Mathers ..... A41D 31/065
2021/0227984 A1 * 7/2021 Lee ..... A63C 17/0026

* cited by examiner

KNEEPAD ADAPTED FOR WORKING ON INCLINED SURFACES

TECHNICAL FIELD OF THE INVENTION

The present invention generally relates to the field of protective equipment for workers. More specifically, the invention relates to a kneepad adapted to working on an inclined work surface such as an inclined roof.

BACKGROUND

Kneepads are commonly used to protect knees from hard surfaces and to provide padding and comfort to users engaged in activities requiring the user to rest on his knees for long periods of time. Kneepads are generally strapped around a person's leg at the knee and allow distributing the weight of the user over a larger and better cushioned surface than the knees.

Common drawbacks associated with known kneepads is that they are mostly designed to be used on horizontal surfaces or that they tend to limit a person's movement over a hard surface, for example when the person needs to move around to its left or right. These drawbacks are particularly significant when the person, such as a roofer, must work cautiously while moving around on an inclined work surface at elevated heights. Some prior art kneepads, strictly designed to be used on horizontal surfaces, do not have the capability to remain in place on the knees of the person as soon as there is a force component, in particular due to gravity, aligned along a tibia of the user. This typically occurs when the user rests on his knees on an inclined surface such as a roof. Some other prior art kneepads provide a significant movement capability to the user by being provided with rollers. These kneepads are of course strictly limited to be used on a flat horizontal surface as they would simply be dangerous for use on an inclined surface.

In view of the above, there is a need for an improved kneepad adapted for working on inclined surfaces which, by virtue of its design and components, would be able to overcome or at least minimize some of the above-discussed concerns.

SUMMARY OF THE INVENTION

In one aspect, there is provided a kneepad adapted to be worn on a wearer's leg for working on an inclined work surface. The kneepad includes:

- a body positionable onto the inclined work surface and including:
  - a pad defining an open cavity for receiving a knee of the wearer, and
  - a contacting interface being adapted to adhere to the inclined work surface and secured to the pad so as to be between the pad and the inclined work surface;
- a leg connector connected to the body of the kneepad and securable to a knee region of the wearer's leg, the leg connector being adapted to abut the pad against the knee when the knee is received within the cavity of the pad; and
- a foot connector connected to the body of the kneepad and securable to a foot region of the wearer's leg, the foot connector extending from the body of the kneepad to the foot region along the wearer's leg when the knee is received within the cavity of the pad, wherein the foot connector is load-bearing to refrain the body from sliding up the wearer's leg by substantially more than a maximum length when a force is applied along the wearer's leg.

In some embodiments, the foot connector comprises a length adjusting system for adjusting a length of the foot connector in accordance with a length of the wearer's leg.

In some embodiments, the foot connector is flexible.

In some embodiments, the foot connector comprises an upper connecting portion being secured to the body of the kneepad, a lower connecting portion being reversibly securable to the foot region of the wearer's leg, and a length adjusting system interconnecting the upper connecting portion and the lower connecting portion and being configured to adjust a length of the foot connector in accordance with a length of the wearer's leg.

In some embodiments, the lower connecting portion of the foot connector is frictionally engaged with a proximal surface of the foot region.

In some embodiments, the foot region is a foot member of the wearer's leg, and the proximal surface of the foot region is a bottom surface of the foot member with lower connecting portion being at least partially positioned inside a footwear of the wearer.

In some embodiments, the foot region is a footwear of the wearer, and the proximal surface of the foot region is a bottom surface of the footwear.

In some embodiments, the upper connecting portion of the foot connector is frictionally engaged with a distal surface of the pad.

In some embodiments, the kneepad further comprises at least one hook component extending outwardly from the distal surface of the pad, the hook component being shaped to receive and retain the upper connecting portion of the foot connector, thereby preventing any sliding thereof from the pad.

In some embodiments, the upper connecting portion and the lower connecting portion are portions of a same strap member forming a loop around the wearer's leg when the knee is received within the cavity of the pad.

In some embodiments, the foot connector further comprises at least one connecting assembly comprising a hook and a ring, with the hook being provided at an end of the upper connecting portion so as to engage the ring being provided at an end of the lower connecting portion.

In some embodiments, the upper connecting portion can be connected to the contacting interface of the kneepad at at least one upper pivot point positioned proximate to a knee portion of the open cavity.

In some embodiments, the foot connector comprises one of a strap, a chain, a cable and a rope.

In some embodiments, the contacting interface comprises a rigid portion extending at least inwardly and outwardly from the pad to define respectively an inner edge portion and an outer edge portion of the contacting interface, and a contacting portion being applied to the rigid portion and being positionable to contact the inclined work surface. The contacting portion is made of a resilient material that is selected to at least partially conform to a shape of the inclined work surface when loaded with at least a portion of a weight of the wearer so as to generate a friction force against the inclined work surface, the friction force having a vertical component at least partially sufficient to retain the wearer on the inclined work surface. For example, the contacting portion can be substantially flat.

In some embodiments, the rigid portion and the pad of the body are formed as a single-piece structure.

In some embodiments, the inner edge portion can have a width that is larger than a width of the outer edge portion to provide an increased friction force when the kneepad is perpendicular to the roof.

In some embodiments, the pad can include an inner bolster defining an inner side of the open cavity and an outer bolster defining an outer side of the open cavity, the inner bolster being higher than the outer bolster, with the inner bolster being sized and shaped to abut an interior portion of the wearer's leg.

In some embodiments, the pad further comprises a distal bolster defining a distal side of the open cavity, the distal bolster being sized and shaped to abut another leg portion above the knee.

In some embodiments, the leg connector comprises three connector members: an upper connector member, a lower connector member and a main leg connector.

In yet another aspect, there is provided a kneepad adapted to be worn on a knee of a leg of a wearer for working on an inclined work surface. The kneepad comprises a body, a leg connector connected to the body of the kneepad and a foot connector connected to the body of the kneepad. The body has a pad and a contacting interface. The pad has an open cavity for receiving the knee of the wearer and the contacting interface is opposed to the open cavity and is adapted to adhere to the inclined work surface. The leg connector is adapted to secure the pad against the knee of the wearer. The foot connector is engageable with a footwear of the wearer and is flexible. When the wearer wears the kneepad, the foot connector is operative to extend substantially parallel to a wearer's leg axis extending between a rotation axis of the knee of the wearer and a rotation axis of an ankle of the wearer, to refrain the body from sliding up the leg of the wearer substantially more than a maximum length, when a force is applied along the wearer's leg axis.

In an embodiment, the foot connector comprises a length adjusting system for adjusting the maximum length of the foot connector.

In an embodiment, the upper connecting portion of the foot connector is connected to the body of the kneepad at an upper pivot point positioned longitudinally proximate a knee portion of the open cavity, and laterally on at least one side of the knee portion.

In an embodiment, the foot connector comprises a lower connecting portion having a lower pivot point. The foot connector further comprises a longitudinal positioning device operative to position the lower pivot point of the lower connecting portion of the foot connector at a predetermined distance from the rotation axis of the ankle of the wearer in a direction of a length of a foot of the wearer.

In an embodiment, a first distance measured from the upper pivot point of the upper connecting portion of the foot connector to the rotation axis of the knee of the wearer is substantially similar to a second distance measured between the lower pivot point of the lower connecting portion of the foot connector and the rotation axis of the ankle of the wearer.

In an embodiment, the longitudinal positioning device comprises a rear guide adapted to abut a rear portion of the footwear of the wearer so as to adequately position the lower pivot point of the lower connecting portion of the foot connector with respect to the rear portion of the footwear.

In an embodiment, the longitudinal positioning device comprises a front guide adapted to abut a front portion of the footwear so as to adequately position the lower pivot point of the lower connecting portion of the foot connector with respect to the front portion of the footwear.

In an embodiment, the foot connector is substantially aligned with a mid-sole portion of the footwear located in front of a heel portion of the footwear.

In an embodiment, the foot connector comprises one of a strap, a chain, a cable and a rope.

In an embodiment, the contacting interface comprises a contacting surface adapted to contact the inclined work surface, the contacting surface being made of a resilient material. The resilient material is adapted to at least partially conform to a shape of the inclined work surface when loaded with at least a portion of a weight of the wearer so as to generate a friction force against the inclined work surface. The friction force has a vertical component at least partially sufficient to retain the wearer on the inclined work surface.

In an embodiment, the contacting surface is substantially flat.

In an embodiment, the contacting interface includes an upper contacting interface portion and a lower contacting interface portion, with the upper contacting interface portion and the lower contacting interface portion being pivotably connected by a pivot allowing the lower contacting interface portion to rotate with respect to the upper contacting interface portion around an axis substantially normal to the contacting surface.

In an embodiment, the pivot is located offset from a center of mass of the lower contacting interface portion such that when the kneepad is worn by the wearer and the wearer is standing up, the center of mass of the lower contacting interface portion is automatically guided below the pivot.

In an embodiment, the pivot allows the lower contacting interface portion to rotate with respect to the upper contacting interface portion around at least two perpendicular axes.

In an embodiment, the open cavity is substantially concave, thereby defining a first bolster on a first side of the open cavity and a second bolster on a second side of the open cavity. The first bolster is higher than the second bolster. The first bolster is adapted to be positioned on an interior portion of the leg of the wearer.

In an embodiment, the kneepad further comprises a third bolster located at a distal end of the open cavity, the third bolster being adapted to contact the leg above the knee.

In yet another aspect, there is provided a kneepad kit comprising a pair of kneepads as defined herein. The pair of kneepads comprises a left kneepad and a right kneepad, the left kneepad being a mirror image of the right kneepad.

While the kneepad will be further described in conjunction with example embodiments, it will be understood that it is not intended to limit the scope of the kneepad to such example embodiments. On the contrary, it is intended to cover all alternatives, modifications and equivalents as may be included as defined by the present description. The objects, advantages and other features of the present kneepad will become more apparent and be better understood upon reading of the following non-restrictive description of the kneepad, given with reference to the accompanying drawings.

BRIEF DESCRIPTION OF THE DRAWINGS

Embodiments of the kneepad and related components are represented in and will be further understood in connection with the following figures.

DETAILED DESCRIPTION

Figure 1A:
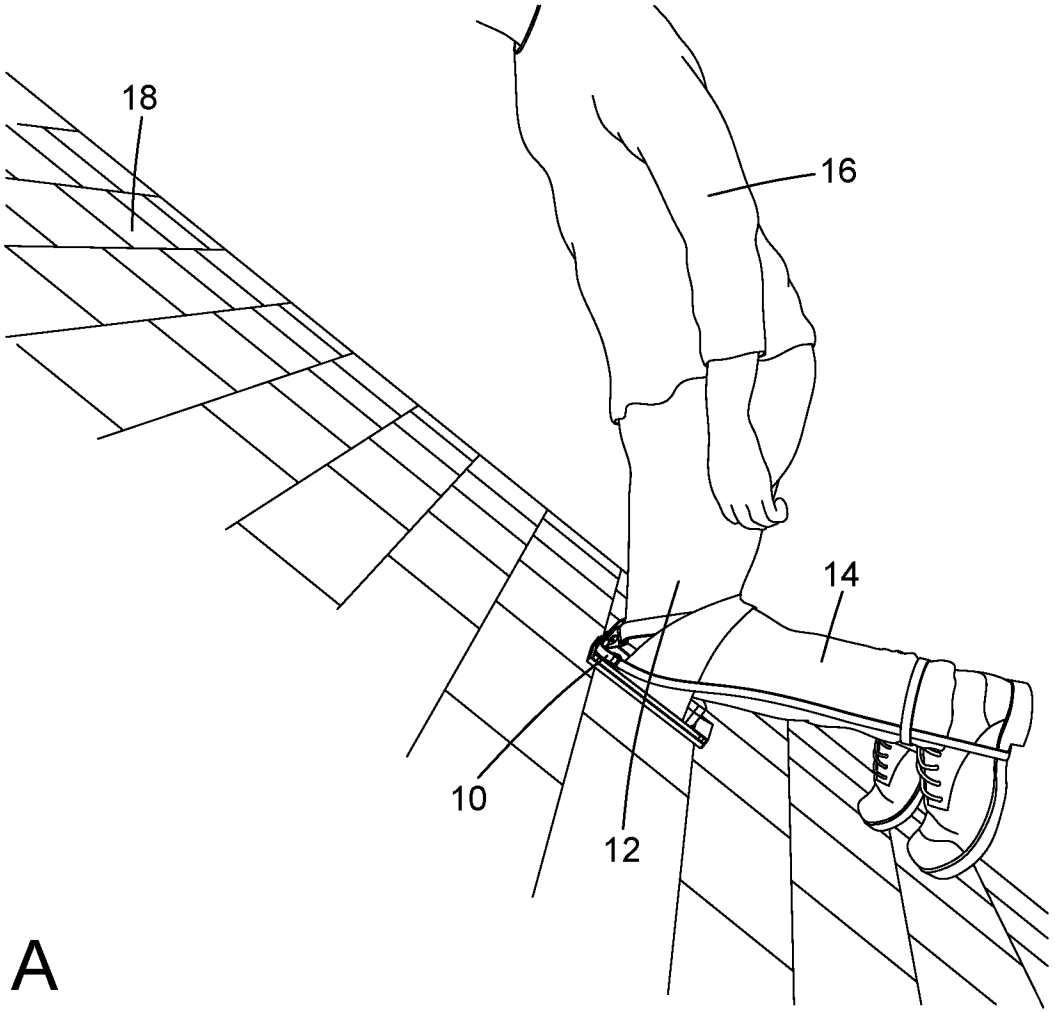
FIG. 1A is a perspective side view of a wearer equipped with kneepads in accordance with an embodiment of the present invention and working on an inclined work surface.

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the kneepad adapted for working on inclined surfaces and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the kneepad adapted for working on inclined surfaces, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The terms "a", "an" and "one" are defined herein to mean "at least one", that is, these terms do not exclude a plural number of items, unless stated otherwise.

Unless stated otherwise, the terms "connected" and "coupled", and derivatives and variants thereof, refer herein to any structural or functional connection or coupling, either direct or indirect, between two or more elements. For example, the connection or coupling between the elements can be acoustical, mechanical, optical, electrical, thermal, logical, or any combinations thereof.

The terms "match", "matching" and "matched" are intended to refer herein to a condition in which two elements are either the same or within some predetermined tolerance of each other. That is, these terms are meant to encompass not only "exactly" or "identically" matching the two elements but also "substantially", "approximately" or "subjectively" matching the two elements, as well as providing a higher or best match among a plurality of matching possibilities.

The present invention relates to a kneepad adapted to be worn safely on an inclined surface, for example by a roofer working on a roof. The kneepad is specifically designed to remain comfortably in place while allowing some freedom of movement to the roofer. In the present description, unless otherwise mentioned, only one kneepad will be described. It is understood that kneepads are typically used and sold in pairs and it is solely for the purpose of keeping the description lighter that only one kneepad will be described. It shall be understood that, according to the present invention and depending on the different embodiments described, one pair of kneepads either includes two identical kneepads, or two kneepads which are substantially a mirror image of each other.

Figure 1B:
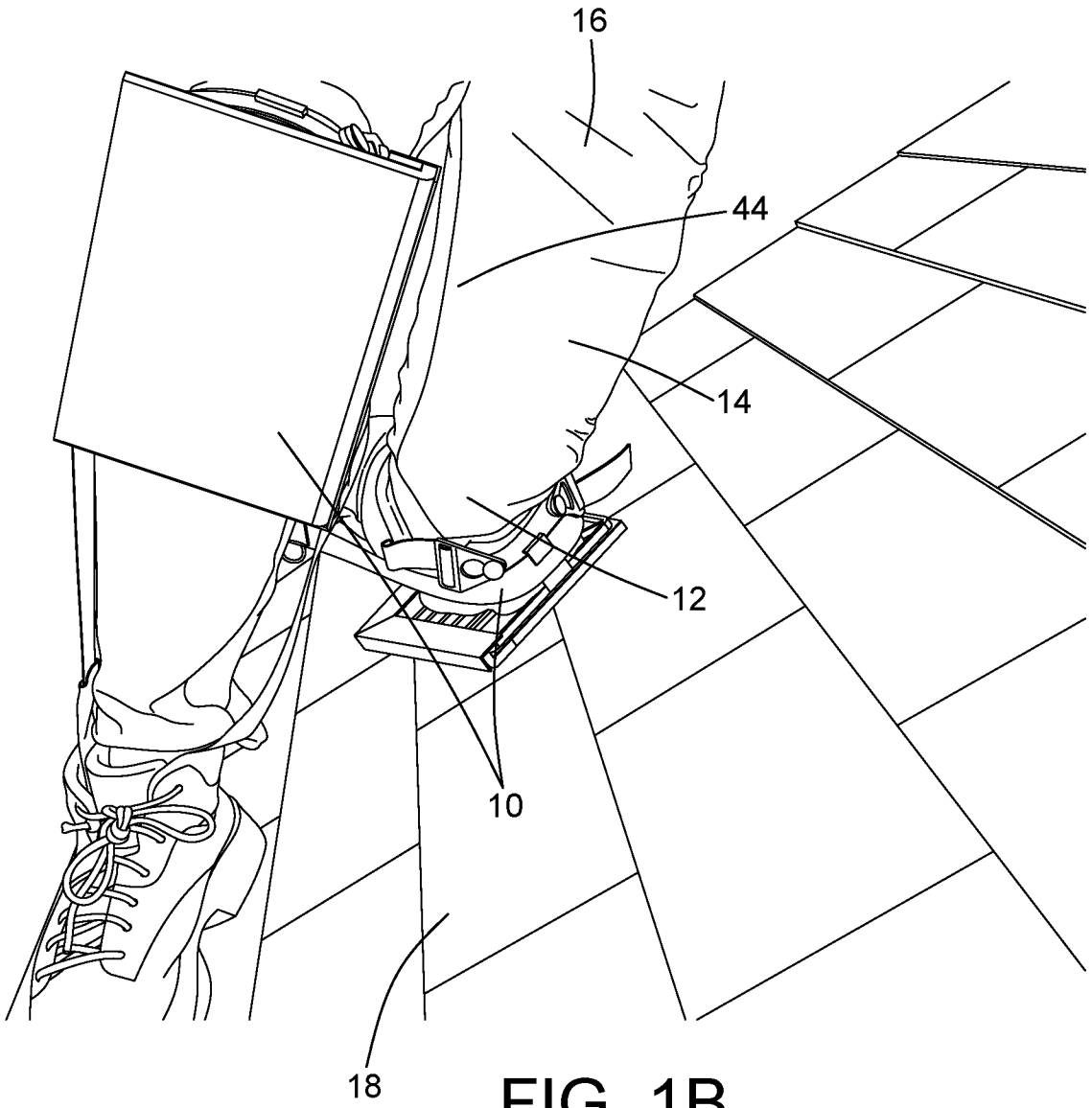
FIG. 1B is a top perspective view of a wearer equipped with kneepads as shown in FIG. 1A, with the wearer being shown in a different working position than in FIG. 1A, where the wearer's leg is positioned perpendicularly to the slope of the inclined work surface, with one of the kneepads engaged with the inclined work surface.

Turning to FIGS. 1A and 1B, in accordance with an embodiment, a kneepad 10 is shown which is adapted to be worn on a knee 12 of a leg 14 of a wearer 16 for working on an inclined work surface 18 at various working angles as better seen in FIG. 1B. In the embodiments shown in FIGS. 2 and 7, the kneepad 10 comprises a body 20, a leg connector 22 that is configured to operatively connect a knee region of the wearer to the body 20 of the kneepad and a foot connector 24 that is configured to operatively connect a foot region of the wearer to the body 20 of the kneepad, thereby distributing mechanical constraints along the leg of the wearer upon use of the kneepad 10. The body 20 includes a pad 26 for receiving the knee of the wearer and a contacting interface 27 for contacting the inclined surface, such as a roof. It is noted that the kneepad 10 shown in FIG. 2 is a right kneepad and the kneepad 10 shown in FIG. 7 is a left kneepad.

Figure 2:
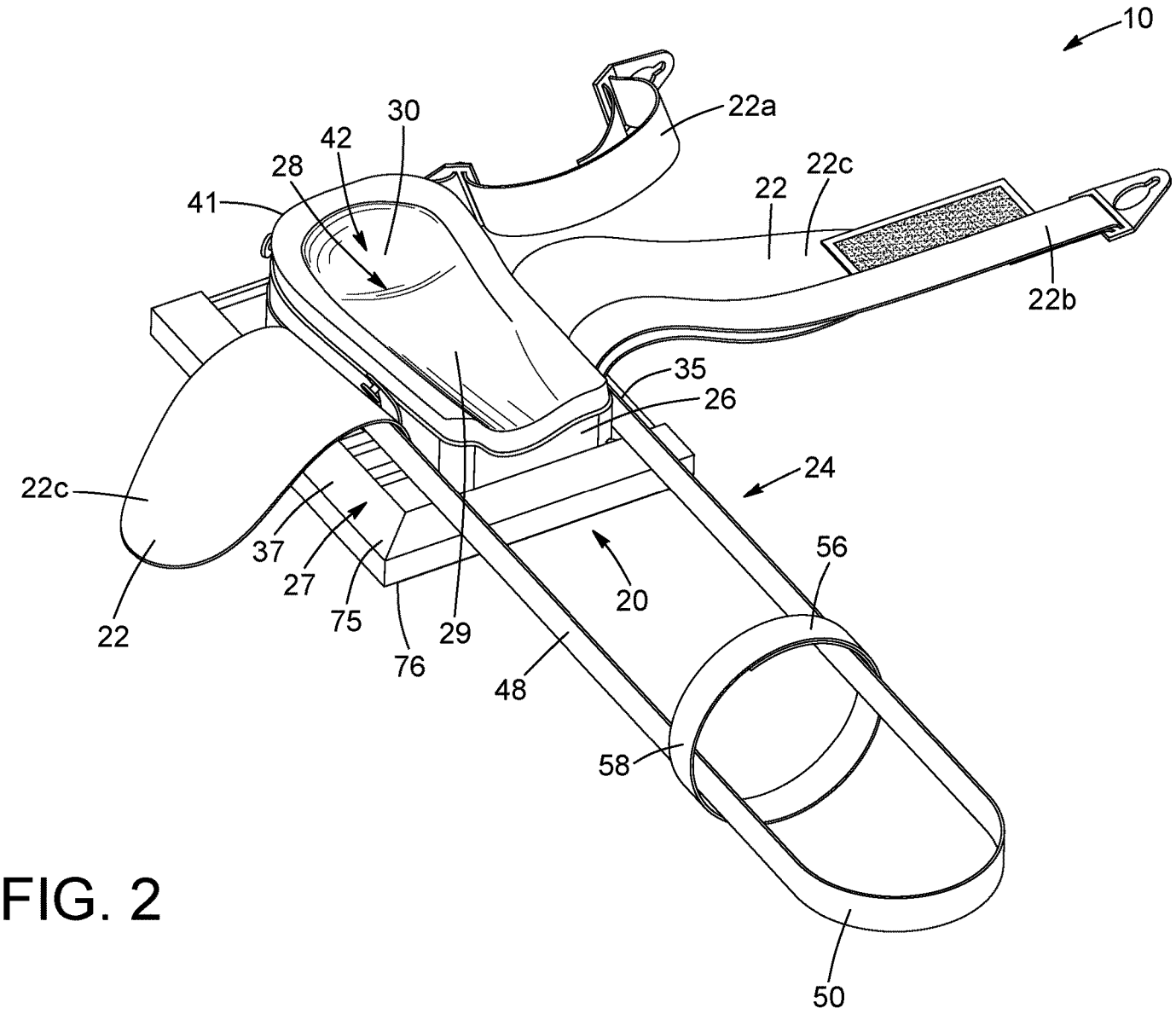
FIG. 2 is a top perspective view of one of the kneepads of FIG. 1A.
Figure 7:
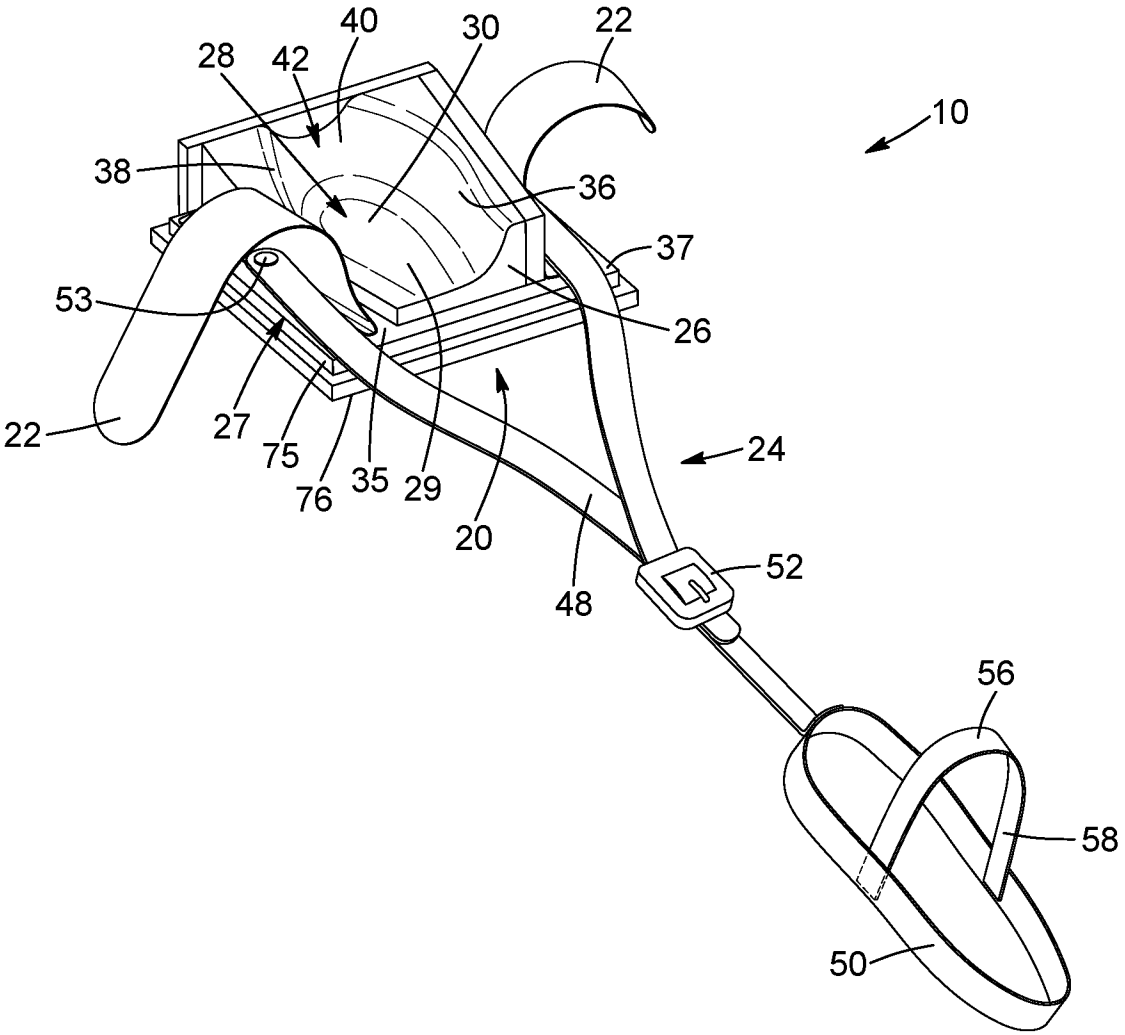
FIG. 7 is a top perspective view of a kneepad according to yet another embodiment of the present invention.

In some embodiments, as for example shown in FIGS. 2 and 7, the leg connector 22 and the foot connector 24 can be separately secured to the body 20 of the kneepad 10. However, it is noted that in other embodiments, the leg connector 22 and the foot connector 24 could be provided as a single-piece harness that would be secured to the body of the kneepad 10 and to at least the knee region and the foot region of the wearer.

Pad

FIGS. 2 and 7 better show embodiments of the body 20 including the pad 26. The pad 26 is sized and shaped to define an open cavity 28 that is recessed within the pad 26 to comfortably receive at least the knee of the wearer in the open cavity 28. In an embodiment, the pad 26 can be at least partially made of a resilient material such as a foam. In an embodiment, a surface 29 of the cavity 28 of the pad 26 can be lined with a softer material. The cavity 28 has a concave shape, such as, for example and without being limitative, a substantially semi-spherical shape, to receive the knee 12 of the wearer within a knee portion 30 of the cavity 28. In an embodiment, the cavity 28 can further include a leg portion 29 that can extend downwardly from the knee portion 30 with a substantially semi-cylindrical shape, to receive a lower region of the leg 14 (between knee and foot region) and therefore increase comfort.

Figure 6:
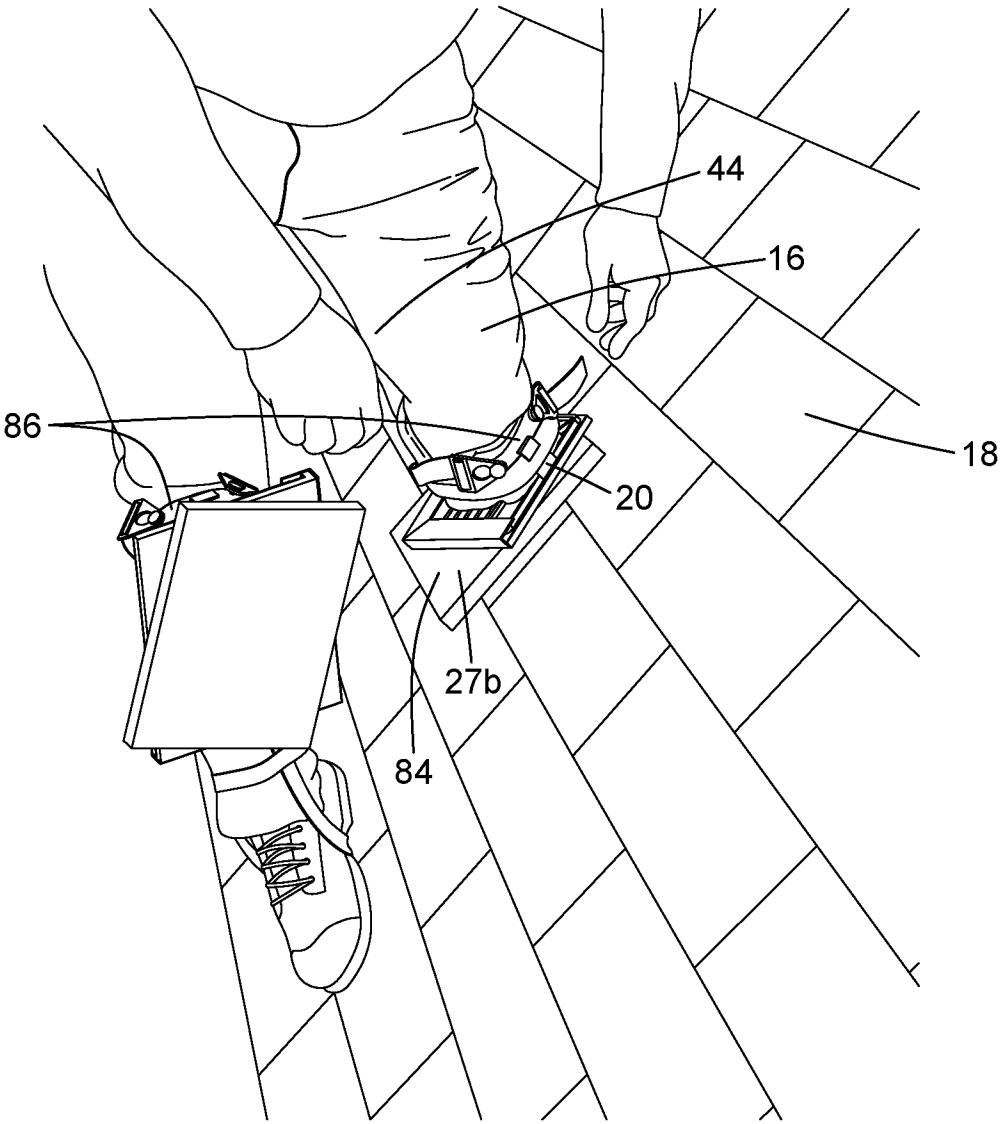
FIG. 6 is a top perspective view of the wearer wearing the kneepads of FIG. 4, with the wearer being shown in a different working position.

In the embodiment shown in FIG. 7, the cavity can be defined by inner, outer and upper (distal) bolsters 36, 38, 40 respectively (also respectively referred to as the first, second and third bolsters). The inner and outer bolsters 36, 38 extend from respective opposed sides of the cavity 28. The inner bolster 36 extends further away from the cavity 28, or from the contacting interface 27 which may also be used as a reference for height, than the outer bolster 38. The inner bolster 36, being higher than the outer bolster 38, is adapted to be abut an interior/inner portion of the knee and leg (not shown in FIG. 7). The higher inner bolster 36 is used as an extension of the cavity 28 when the knee 12 and/or leg 14 of the wearer 16 become misaligned with the kneepad 10, for example when the wearer 16 places his leg 14 sideways across the inclined work surface 18 (as shown in FIGS. 1B and 6), the inner bolster 36, higher than the outer bolster 38, is placed to abut an interior portion 44 of the wearer's leg and helps maintain the knee 12 and/or leg 14 of the wearer in place.

It is noted that the term "inner" can be used in relation to parts and surfaces that are positioned proximal to an inner side of the leg/knee, whereas the term "outer" can be used in relation to parts and surfaces that are positioned proximal to an outer side of the leg/knee. The terms "upper" and "distal" can be used in relation to parts and surfaces that are positioned upstream of the knee in a direction of the inclined surface (or in front of the knee when engaged within the cavity of the pad). A distal surface/portion of the kneepad may thus be referred to as an upper surface/portion thereof when the kneepad is abutted against the inclined work surface. The terms "lower" and "proximal" can be used in relation to parts and surfaces that are positioned downstream of the knee in a direction of the inclined surface (or behind the knee in a direction of the leg towards the foot region, when engaged within the cavity of the pad). A proximal surface/portion of the kneepad may thus be referred to as a lower surface/portion thereof when the kneepad is abutted against the inclined work surface.

Advantageously, the semi-spherical knee portion and the semi-cylindrical leg portion 29 of the cavity 28 allow the knee 12 and leg 14, when engaged within the cavity 28, to partially pivot/rotate with respect to the kneepad 10, ensuring that the lower contacting interface 27 remains fully in contact with the inclined work surface 18 for different positioning of the leg within the cavity 28 and bolsters. When the wearer is so positioned, the allowed partial rotation of the knee 12 and leg 14 with respect to the kneepad 10, combined with the extended contact surface provided by a higher inner bolster 36, contribute to increasing the wearer's comfort since his weight is transferred to the body 20 of the kneepad 10, through the padded inner bolster 36.

It will be understood that when the kneepad 10 is used with the wearers leg being substantially aligned with the inclination of the inclined work surface 18 (see FIG. 1A), the weight of the wearer is substantially supported by a foot connector 24, while, when the kneepad 10 is used with the wearer's leg being substantially sideways across the inclined work surface 18 (see FIGS. 1B and 6), the weight of the wearer is effectively supported by the inner bolster 36. The upper bolster 40, which is provided at a distal end 42 of the cavity 28, is adapted to contact the portion of the leg 14 located above the knee 12 in order to further protect the knee 12, provide increased comfort and support to the knee 12, and/or help maintaining the kneepad 10 in place when the wearer is in a standing position.

Contacting Interface

The contacting interface 27 of the body 20 of the kneepad 10 is positioned opposed to the inner surface 29 and serves to provide adhesion on the inclined work surface 18. The contacting interface 27 typically includes a top rigid portion 75, made of a rigid material, and a substantially wear-resistant and resilient material contacting portion 76, made of an anti-skid material of a certain thickness, making it adapted to adhere to the inclined work surface 18. The resilience and thickness of the material of the contacting portion allow the contacting interface 27 to conform to a shape of the inclined work surface 18 when loaded with at least a portion of the weight of the wearer 16, thereby increasing a friction force between the contacting interface 27 and the inclined work surface 18. The friction force has a vertical component which is at least partially sufficient to retain the wearer 16 on the inclined work surface 18. For a given contacting portion material, the friction coefficient will vary not only depending on the types of materials involved (for example, whether roofing is made of asphalt composite shingles, metal roofing or shingles, wood shingles, clay tiles, etc.), but also on temperature and weather conditions (rain, for example, will decrease the friction coefficient). Advantageously, the contacting interface 27 (including a resilient material contacting portion 76) can be substantially flat, although different shapes may be better adapted to different types of roofs. Advantageously, the use of the contacting interface as part of the kneepad 10 avoid or at least reduce potential damages that could be done to the work surface, e.g., to asphalt shingles in warm to hot working conditions.

Referring to FIGS. 2 and 7, the material used for the contacting portion 76 could extend from at least one edge of the rigid portion 75 of the contacting interface 27 to help refrain the material used for the contacting portion 76 to peel from the rigid portion 75 of the contacting interface 27. Optionally, the material used for the contacting portion 76 can extend from at least the lower/proximal edge and the inner edge of the rigid portion 75 of the contacting interface 27. It is further noted that the contacting portion can extend over at least a side surface of an inner edge of the rigid portion of the contacting interface, as seen in FIG. 1B.

In an embodiment, the contacting portion 76 can be further secured to at least one of the lower/proximal edge or the inner edge of the rigid portion 75. For example, the contacting interface can include a bracket that encases at least one of the lower/proximal edge or the inner edge of the rigid portion 75 so as to sandwich the contacting portion between the bracket and the rigid portion. The bracket can be made of steel and a screw can be used to secure the bracket through the material contacting portion.

In some embodiments, as shown in FIGS. 2 and 7, the contacting interface 27 can extend outwardly and inwardly from the pad 26 so as to respectively define an outer edge portion 35 and an inner edge portion 37 of the contacting interface 27. Advantageously, the width of the inner edge portion can be different from the width of the outer edge portion 35 to accommodate for the slope of the roof. As, the normal force of the worker 16 is aligned with the gravity and passes through the knee 12, when the worker 16 turns his leg 14 from parallel to the slope to perpendicular, the weight of the knee shifts from the inner surface 29 to inner bolster 36. As the slope gets steeper, the normal force still passes through the contacting portion 76 as the inner edge portion 37 of the contacting interface 27 is wider. It is noted further noted that the contacting portion can extend over at least a side surface of an inner edge of the rigid portion of the contacting interface, as seen in FIG. 1B.

More detail is provided now with respect to the leg connector 22 and foot connector 24 of the kneepad 10. As mentioned, the leg connector 22 and the foot connector 24 are secured to the body of the kneepad and further attached to the respective knee region and foot region of the wearer. For example, the leg connector 22 and the foot connector 24 can be secured to the pad 26 and/or to edge portions of contacting interface 27 extending outwardly with respect to the pad 26.

Leg Connector

The leg connector 22 is fixed to the body 20 of the kneepad 10 and is typically attached to the wearer 16 behind or on the side of the leg 14 or knee 12 so as to snugly secure the pad 26, and therefore the body 20 of the kneepad 10, against the knee 12. For example, and without being limitative, in different embodiments, the leg connector 22 can be made of straps, laces, flaps, a stretchable fabric stretched over the leg 14, a combination thereof, etc. The leg connector 22 can be equipped with user-friendly fasteners such as one or more buckles, hook and loop fasteners, zipper, buttons or the like.

In some embodiments, as shown in FIGS. 2 and 7, the leg connector 22 can include an inner member and an outer member, each having one end secured to one edge portion 35, 37 of the contacting interface 27 of the body 20 of the kneepad 10.

In the embodiment shown in FIG. 2, the leg connector 22 can comprise multiple different connector members: an upper connector member 22*a*, a lower connector member 22*b* and a main leg connector 22*c*. The upper connector member 22*a* has both ends fixed a distal surface 41 of the pad 26. The lower connector member 22*b* has one end fixed on the inner edge portion 37 and one edge fixed on the outer edge portion 35 of the contacting interface 27. The main leg connector member 22*c* is also fixed on the edge portions 35 and 37 of the contacting interface 27, outwardly of the lower connector member 22*b*. In another embodiment shown in FIG. 7, the leg connector 22 is fixed to the rigid portion 75 of the contacting interface 27 of the body 20 of the kneepad 10.

In an embodiment (not shown) where the body 20 of the kneepad 10 is longer to extend over a portion of the leg 14, the leg connector 22 can attach behind or on the side of the leg 14 to secure the body 20 of the kneepad 10 against the leg 14 as well.

Foot Connector

The foot connector 24 is configured to prevent the body 20 of the kneepad 10 from sliding up the leg 14 of the wearer 16, when the wearer 16 rests at least a portion of its weight on his knee 12, against the inclined work surface 18. Indeed, when the wearer 16 rests at least a portion of its weight on his knee 12, against the inclined work surface 18, gravity forces the wearer 16 down, while a friction force created between the contacting interface 27 and the inclined work surface 18 by the weight of the wearer 16, at least partially (depending on the friction coefficient between both surfaces) keeps the kneepad 10 in place on the inclined work surface 18.

Naturally, the kneepad 10 must be properly attached to the leg 14 (which includes the knee 12) of the wearer 16 to maintain the wearer 16 in place on the inclined work surface 18. To prevent the body 20 of the kneepad 10 from sliding up the leg 14, at least not substantially more than the maximum length at which it is adjusted, and substantially increase the comfort of the wearer, the foot connector 24 reaches and engages a foot of the same leg 14 of the wearer 16. In the embodiment shown, the foot connector 24 reaches and engages a foot region 46 of the wearer 16, on the same leg 14 as the corresponding kneepad 10.

The securing of the foot connector to the body of the kneepad is performed so as to provide an additional load-bearing region at the foot region of the wearer, thereby distributing the load of the knee from the body of the kneepad and along the foot connector. Such securing can be performed in various ways and the example embodiments provided herein are not limiting. For example, in the embodiment shown in FIG. 7, the foot connector 24 is secured to edge portions 35, 37 of the contacting interface 27 of the kneepad 10 via a pin-and-hole system 53. In another embodiment, as shown in FIG. 2, the foot connector 24 can engage at least a portion of the distal surface 41 of the pad 26. Both examples of securing means allow for a controlled pivoting of the leg with respect to the knee portion of the cavity at different angles.

The foot connector 24 can comprise different components, parts or portions.

For example, and without being limitative, in the embodiments shown, the foot connector 24 includes an upper (or first) connecting portion 48, a lower (or second) connecting portion 50 and a length adjusting system 52.

Referring to the embodiment shown in FIG. 7, the upper connecting portion 48 is connected to the body 20 of the kneepad 10 at an upper pivot point 53 (pin-and-hole system). The upper connecting portion 48 is connected to the edge portions 35, 37 of the contacting interface 27 of the body 20 of the kneepad 10. In the embodiment shown in FIG. 7, the upper pivot point 53 is located at a longitudinal position that is proximate the knee portion 30 of the cavity 28, and at a lateral position that is at least on one side of the knee portion. One skilled in the art will however understand, that for stability reasons, it may be better to connect the upper connecting portion 48 to the body 20 of the kneepad 10 on each side of the cavity 28, thereby using two symmetrically placed pivot points 53.

In some embodiments, as shown in FIG. 7, the pad 26 of the body 20 can have a substantially trapezoid shape, with the width of an upper portion thereof being greater than the width of a lower portion thereof, thereby allowing a greater freedom of movement of the upper (or first) connecting portion 48 of the foot connector 24.

Figure 11:
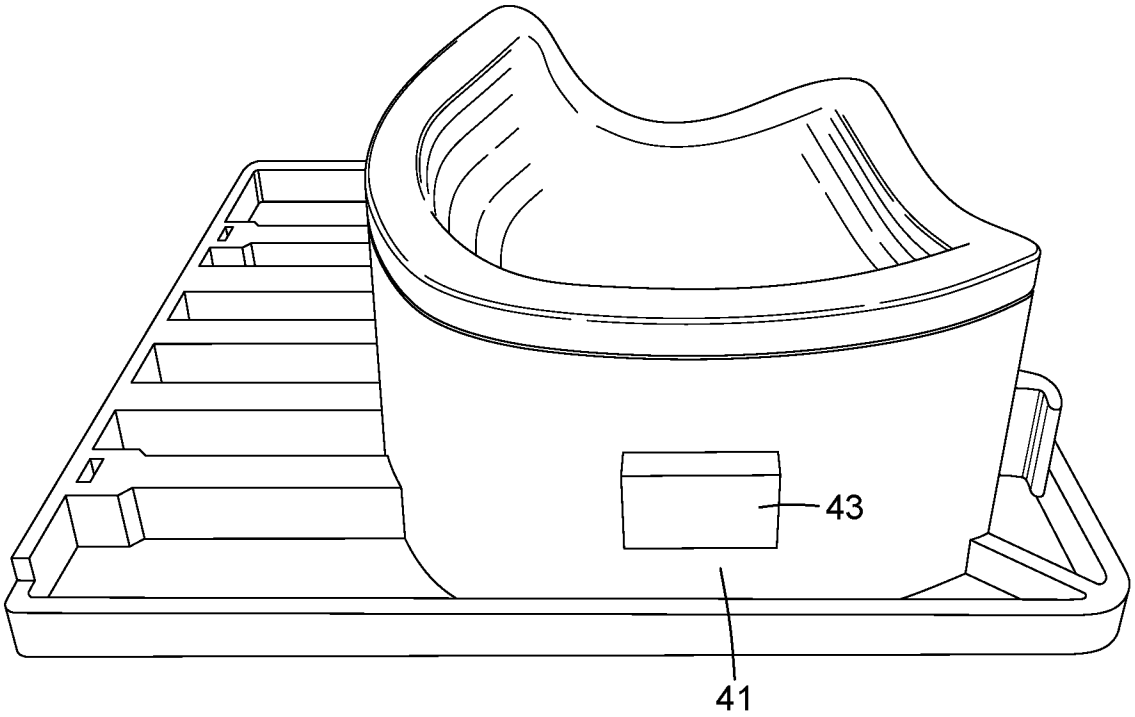
FIG. 11 is a top perspective view of a body of the kneepad according to an embodiment of the present invention showing a distal surface including a hooking component for engaging the foot connector for example shown in FIGS. 9 and 10.

In another example, in the embodiment shown in FIG. 2, the foot connector 24 can be provided such that the first and second connecting portions 48, 50 define a loop that can receive the pad 26 therethrough such that the first connecting portion 48 abuts the distal surface 41 of the pad 26. When in use and tighten, the first connecting portion 48 of the foot connector 24 is frictionally engaged with the distal surface 41 (better seen in FIG. 11) of the pad 26 of the kneepad 10. The first connecting portion 48 loops around the kneepad 10, following the curve of the distal surface 41 of the pad 26. One skilled in the art will however understand that, although the friction of the upper connecting portion 48 on the front surface 41 of the pad 26 prevents the foot connector 24 from sliding from one side surface to the other (from inner to outer surface of the pad and vice versa) when tighten, the foot connector 24 can be provided free and unsecured to the pad 26 when not in use. Optionally, to facilitate the positioning of the foot connector 24 on the pad 26 for tightening around the lower leg (from knee to foot region), the pad 26 can include at least one hook component 43 protruding outwardly from the distal surface 41 of the pad 26, as better seen in FIG. 11. The hook component 43 can serve as a guide for insertion of the first connecting portion 48 of the foot connector 24 (not shown in FIG. 11) and positioning along the distal surface 41 of the pad 26.

In the embodiments shown, the upper (first) connecting portion 48 of the foot connector 24 is connected to the lower (second) connecting portion 50 with the length adjusting system 52. Indeed, the length adjusting system 52 is configured to adjust a length of at least one of the upper (first) connecting portion 48 and the lower (second) connecting portion 50 of the foot connector, thereby tailoring the tightening of the foot connector to people of different sizes and heights for providing a more universal fit and ensure a comfortable use of the kneepad. The length adjusting system 52 is configured to provide an adjustable maximum length to the foot connector 24, thereby preventing the pad 26 from moving up the leg 14 of the wearer 16 when in use on an inclined surface. The foot connector 24 can be made of a material which is flexible in compression, but rigid in tension, such as a strap, a chain, a cable, a rope or the like, or a combination thereof. Optionally, the upper (first) connecting portion 48 of the foot connector 24 can be made of a different material than the lower (second) connecting portion 50.

Figure 3:
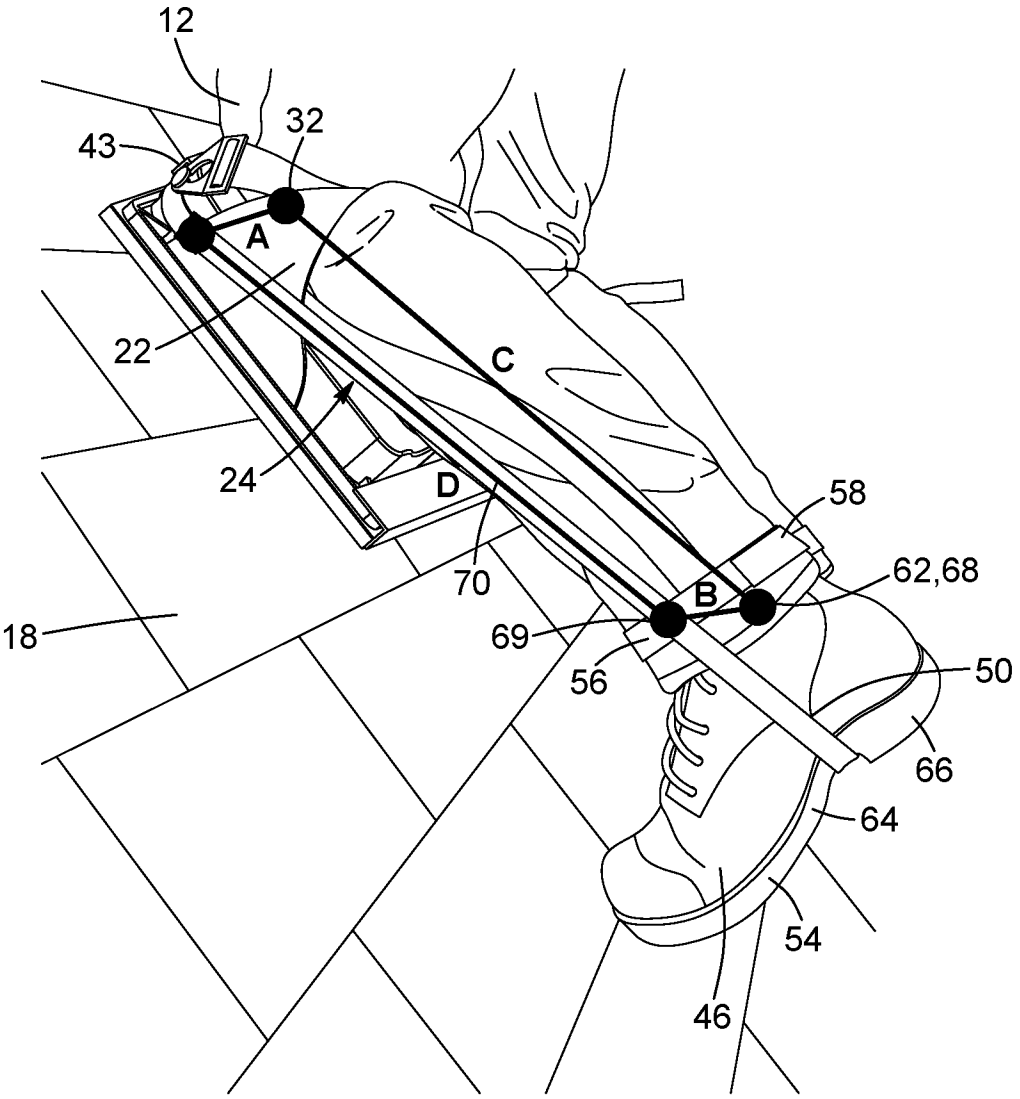
FIG. 3 is a side perspective close-up view of a left leg of the wearer equipped with the left kneepad of FIG. 1A.
Figure 5:
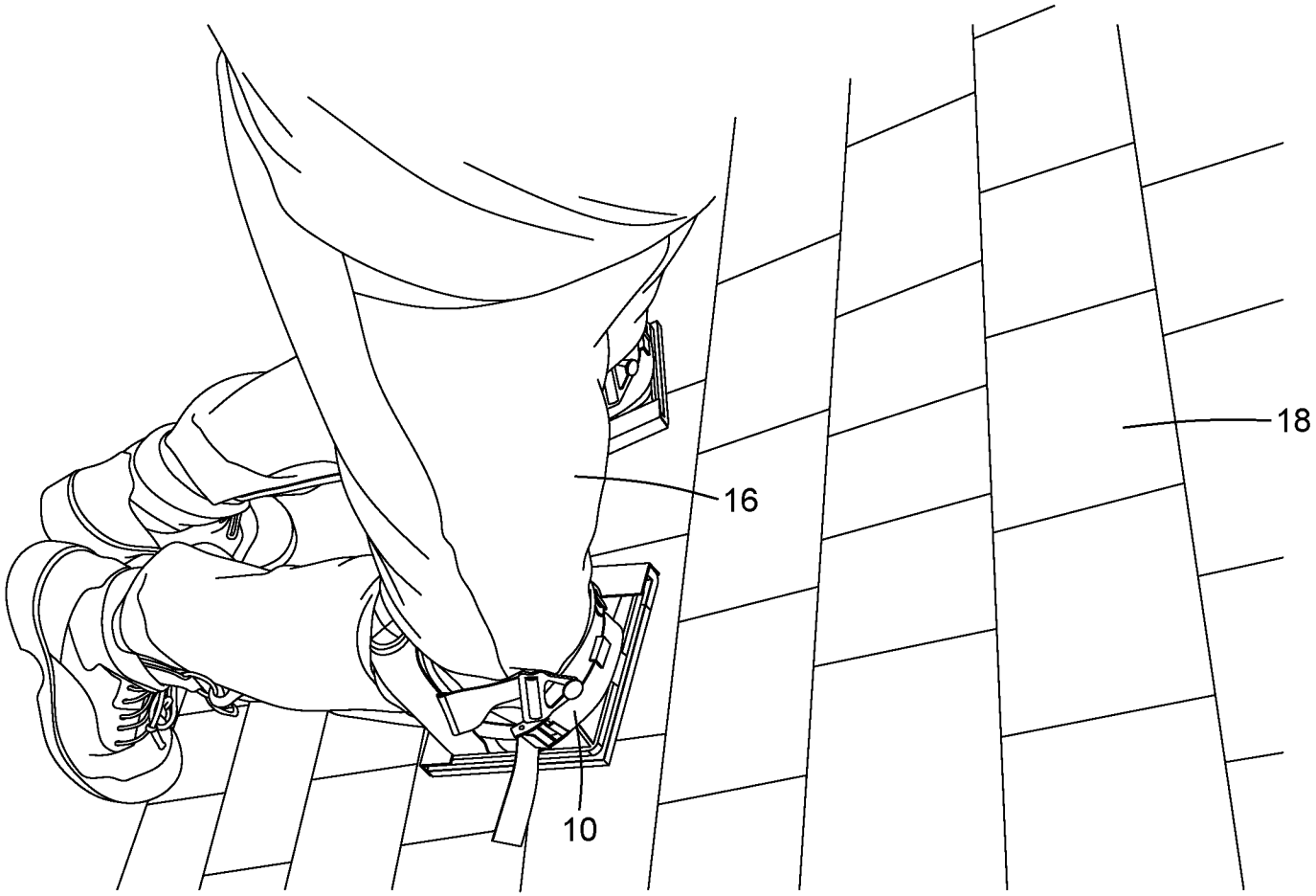
FIG. 5 is a top perspective view of a wearer wearing left and right kneepads according to another embodiment of the present invention.

The lower connecting portion 50 of the foot connector reaches further down to engage the foot region 46 of the wearer 16. One skilled in the art will understand that the lower connecting portion 50 can be configured to engage the foot region 46 of the wearer 16 in different ways, such as, for example and without being limitative, by passing underneath a sole 54 of a footwear, as is depicted in FIG. 3, by passing underneath the foot member inside the footwear as seen in FIG. 5, or through a different assembly, such as clips, buttons, snaps or other type of fastener providing a detachable connecting interface.

Thus, the foot region 46 can refer to the footwear or the foot member of the wearer and the foot connector can be secured to an outside of the footwear, an inside of the footwear, and/or directly to the foot member. It is noted that the material and width of at least the lower (second) connecting portion 50 can be adapted to the nature of the securing to the foot region. For example, the lower (second) connecting portion 50 can be selected wider when engaging the foot member to enhance user's comfort than when engaging a sole of the footwear.

It is noted that the foot connector can be provided as including a single strap member that is positioned to surround the pad and the foot region, and the length adjusting system is provided at one end of the strap so as to engage the other end of the strap and tighten the strap when surrounding the pad and foot region as a loop.

Figure 8:
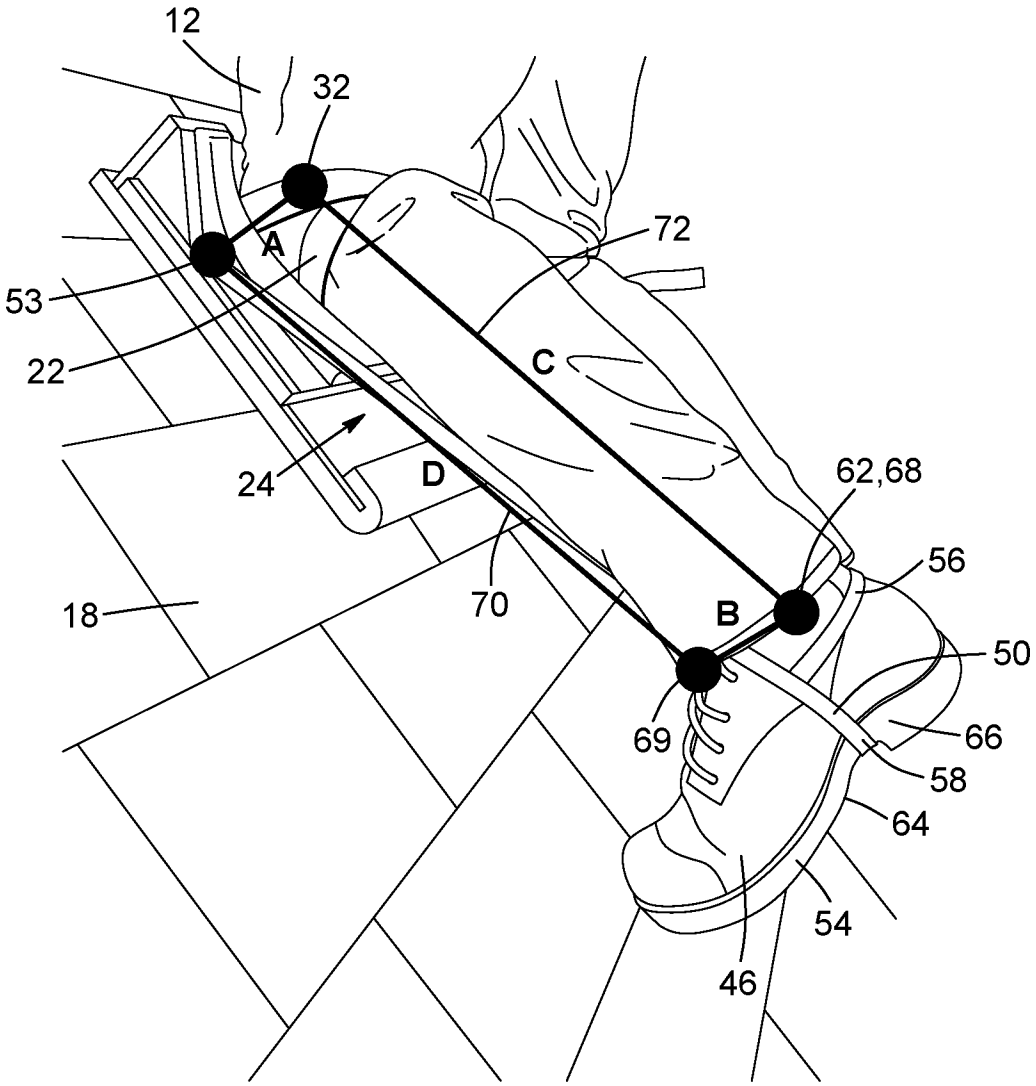
FIG. 8 is a side perspective close-up view of a left leg of the wearer equipped with the left kneepad of FIG. 7.
Figure 9:
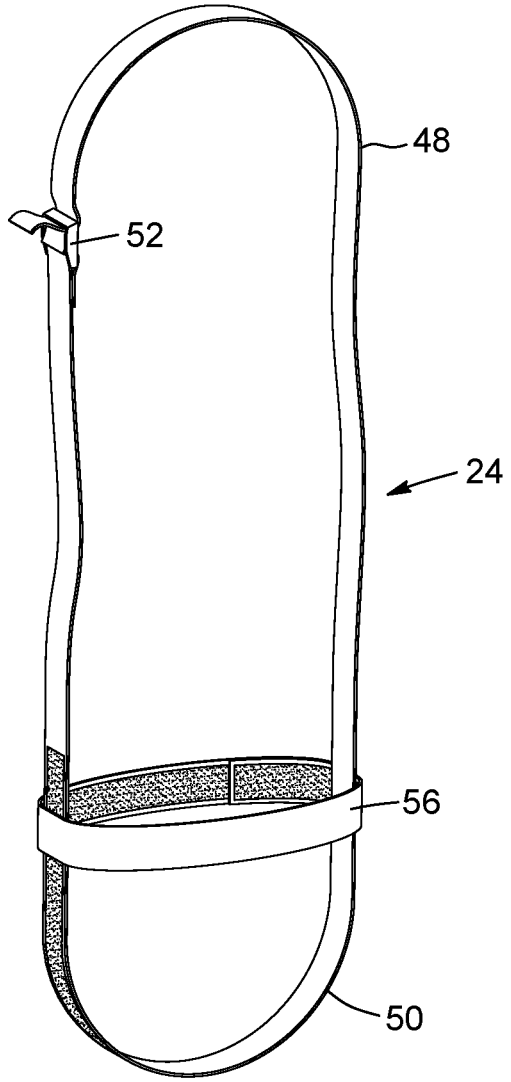
FIG. 9 is a perspective view of a foot connector of the kneepad according to an embodiment of the present invention.
Figure 10:
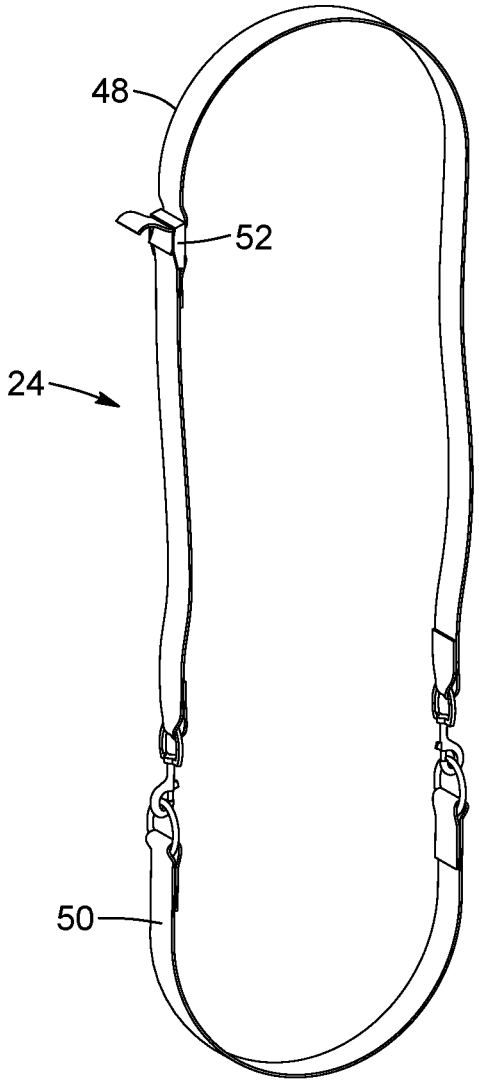
FIG. 10 is a perspective view of a foot connector of the kneepad according to another embodiment of the present invention.

It is noted that various designs of the lower connecting portion 50 can be used to provide for the additional load-bearing region. FIGS. 7 and 8 show a first design where the lower connecting portion 50 includes multiple members surrounding different parts of the foot region including the ankle. FIG. 9 provides for a simpler loop design including an additional guide member surrounding the foot region, and that can be worn above the footwear. FIG. 10 shows a lower connecting portion 50 including additional connecting assemblies (e.g., hook-and-ring assemblies) to facilitate the anchoring of the kneepad to the wearer when the lower connecting portion 50 is worn inside the footwear and around the foot member.

More particularly, in the embodiment shown in FIG. 9, the foot connector 24 is used with the foot region being footwear. The lower (second) connecting portion 50 frictionally engage the sole. A longitudinal positioning device 56 (guiding member) wraps around the ankle to secure the position of the lower (second) connecting portion 50 with respect to the rotation axis of the ankle 68 of the wearer in a direction of a length of a foot of the wearer. The longitudinal positioning device 56 can be secured to the lower (second) connecting portion 50 with a reversible fastener, such as hook and loop.

In the embodiment shown in FIG. 10, the foot connector is used with the foot region being the foot member. Optionally, the lower (second) connecting portion 50 can be made larger than in an embodiment wherein the foot connector is used in connection with footwear to enhance the wearer's comfort. the lower connecting portion can include two detachable connecting assemblies 49 allowing interconnecting the upper (first) connecting portion 48 and the lower (second) connecting portion 50, such as the shown hook-and-ring assemblies 49. The use of at least one detachable connecting assembly 49 allows the user to install the lower (second) connecting portion 50 in his/her footwear at the beginning of the day and connect it to the upper (first) connecting portion 48 and the rest of the kneepad when needed.

One skilled in the art will understand that, in an alternative embodiment (not shown), the lower connecting portion 50 could be permanently connected to the footwear 46, with the upper connecting portion 48 being removably connected to the body 20 of the kneepad 10 at an upper pivot point 53, using a detachable connecting assembly such as clips, buttons, snaps, or the like. In another alternative embodiment (not shown), the lower connecting portion 50 and the upper connecting portion 48 could both be permanently connected respectively to the footwear 46 and the body 20 of the kneepad 10, with the length adjusting system 52 providing a detachable interface, allowing the lower connecting portion 50 and the upper connecting portion 48 to be connected and disconnected from one another.

In the embodiment shown in FIG. 8, the foot connector 24 is further provided with a longitudinal positioning device 56 which serves to position the lower connecting portion 50 at a user desired position along a length of the foot region 46. In other words, the longitudinal positioning device 56 allows positioning a lower pivot point 69 of the lower connecting portion 50 of the foot connector 24 at a predetermined distance from a rotation axis of the ankle 68 of the wearer in a direction of a length of a foot of the wearer.

Still referring to FIG. 8, the longitudinal positioning device 56 comprises a guide 58 adapted to engage a rear portion of the foot region 46 so as to position the lower pivot point 69 of the lower connecting portion 50 of the foot connector 24 with respect to an ankle portion 62, and thereby prevent the lower connecting portion 50 from being displaced further towards a front portion of the foot region 46. In an embodiment (not shown), the longitudinal positioning device 56 could further comprise a front guide adapted to engage a front portion of the foot region 46 so as to also position the lower pivot point 69 of the lower connecting portion 50 of the foot connector 24 with respect to this front portion of the foot region and prevent it from sliding towards the rear portion of the foot region. For example, the lower pivot point 69 of the lower connecting portion 50 of the foot connector 24 can be substantially aligned with a mid-sole portion 64 of the footwear 46 located in front of a heel 66 of the footwear 46. Conveniently, the lower pivot point 69 of the lower connecting portion 50 of the foot connector 24 may be positioned at a predetermined distance in front of the ankle portion 62 of the footwear 46 in a direction of a length of the footwear 46. The ankle portion 62 substantially corresponds to the area where bulges could be provided on each side of the footwear 46 to accommodate the wearer's ankle.

Still referring to the embodiment shown in FIG. 8, the upper pivot point 53 of the upper connecting portion 48 and the lower pivot point 69 of the lower connecting portion 50 can be positioned to increase comfort and ease of movement of the wearer 16 using the kneepad 10. It will be understood that the lower pivot point 69 is the lower point where the lower connecting portion 50 is free to pivot. Indeed, it may be advantageous to position these two pivot points so that the upper connecting portion 48 is connected to the body 20 of the kneepad 10 at the upper pivot point 53 which is at a first distance A from a knee rotation axis 32, with the distance A being similar in length and substantially parallel in orientation to a second distance B measured between the lower pivot point 69 of the lower connecting portion 50 and an ankle rotation axis 68 of the wearer 16. The ankle rotation axis 68 is anatomically dependent on the body of each wearer 16. However, the ankle rotation axis 68 substantially corresponds to a center of the ankle portion 62. By strategically placing both the upper pivot point 53 and the lower pivot point 69, a deformable imaginary parallelogram 70 is created between the knee rotation axis 32, the upper pivot point 53, the lower pivot point 69 and the ankle rotation axis 68. Again, the distance A is substantially equal to the distance B and their orientations are substantially parallel. Consequently, the lines C and D are necessarily substantially equal and parallel too, thereby creating the imaginary parallelogram 70. Creating such a deformable parallelogram geometry allows the foot connector 24 to move substantially parallel to a wearer's leg axis 72 (which extends substantially between the knee rotation axis 32 and the ankle rotation axis 68) without hitting it during use of the kneepad 10 by the wearer 16. This geometry also allows the wearer 16 to easily lift his foot without lifting the kneepad while maneuvering on the inclined work surface 18, potentially adding a level of stability. Indeed, as the foot is lifted from the inclined work surface 18, the foot simply rotates around the ankle rotation axis 68 and no tension is otherwise created in the elements making the parallelogram 70.

Now referring to FIG. 3, the lower point where the upper connecting portion 48 gets in contact with the distal surface 41 of the pad 26 and the lower pivot point 69 of the lower connecting portion 50 can be positioned to increase comfort and ease of movement of the wearer 16 using the kneepad 10. It will be understood that the lower pivot point 69 is the lower point where the lower connecting portion 50 is free to pivot. Indeed, it may be advantageous to position these two pivot points so that the upper connecting portion 48 is connected to the body 20 of the kneepad 10 the lower point where the upper connecting portion 48 gets in contact with the distal surface 41 of the pad 26 which is at a first distance A from a knee rotation axis 32, with the distance A being similar in length and substantially parallel in orientation to a second distance B measured between the lower pivot point 69 of the lower connecting portion 50 and an ankle rotation axis 68 of the wearer 16. The ankle rotation axis 68 is anatomically dependent on the body of each wearer 16. However, the ankle rotation axis 68 substantially corresponds to a center of the ankle portion 62. By strategically placing both the lower point where the upper connecting portion 48 gets in contact with the distal surface 41 of the pad 26 and the lower pivot point 69, a deformable imaginary parallelogram 70 is created between the knee rotation axis 32, the lower point where the upper connecting portion 48 gets in contact with the distal surface 41 of the pad 26, the lower pivot point 69 and the ankle rotation axis 68. Again, the distance A is substantially equal to the distance B and their orientations are substantially parallel. Consequently, the lines C and D are necessarily substantially equal and parallel too, thereby creating the imaginary parallelogram 70. Creating such a deformable parallelogram geometry allows the foot connector 24 to move substantially parallel to a wearer's leg axis 72 (which extends substantially between the knee rotation axis 32 and the ankle rotation axis 68) without hitting it during use of the kneepad 10 by the wearer 16. This geometry also allows the wearer 16 to easily lift its foot without lifting its knee while maneuvering on the inclined work surface 18, potentially adding a level of stability. Indeed, as the foot is lifted from the inclined work surface 18, the foot simply rotates around the ankle rotation axis 68 and no tension is otherwise created in the elements making the parallelogram 70.

Additional Pivot

Figure 4:
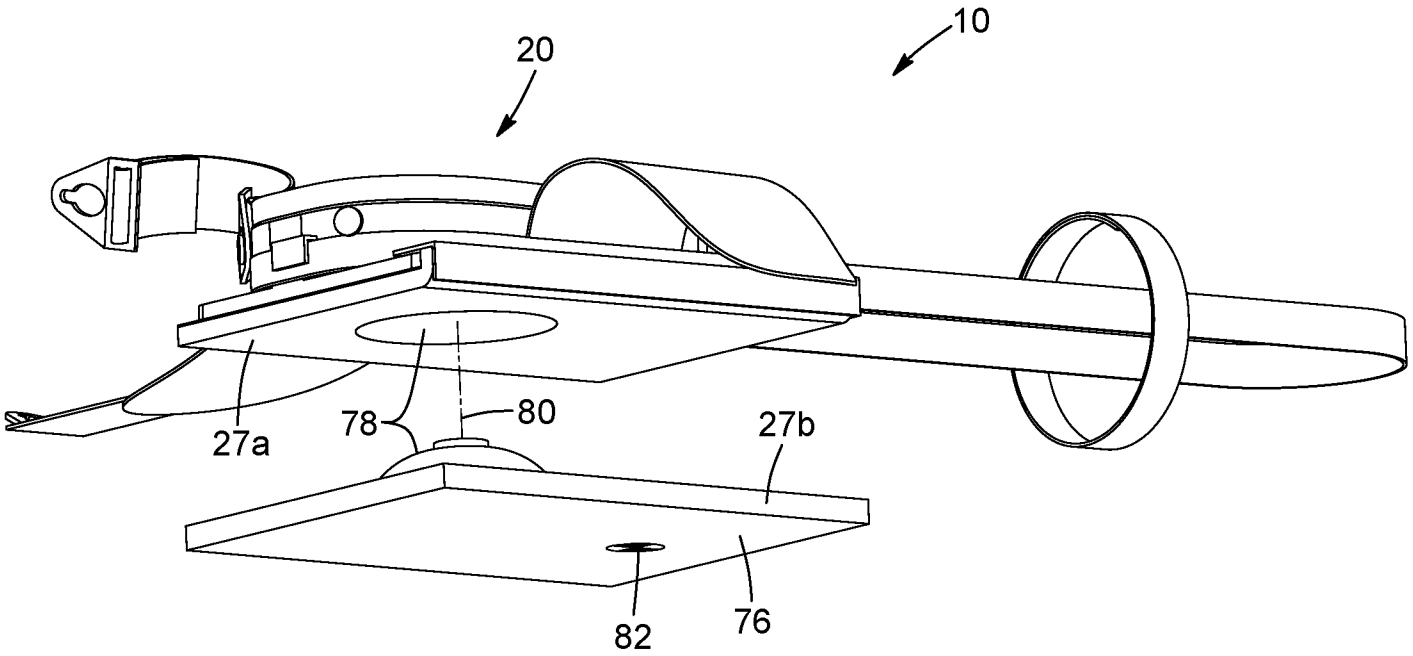
FIG. 4 is a partially exploded perspective view of a kneepad in accordance with an alternative embodiment of the present invention.

Turning now to FIGS. 4 to 6, there is shown an alternative embodiment of the kneepad, where the kneepad 10 provides further maneuverability possibilities to the wearer 16. Indeed, in this alternative embodiment, the contacting interface 27 includes an upper contacting interface portion 27*a* and a lower contacting interface portion 27*b*, with a pivot 78 located between the upper contacting interface portion 27*a* and the lower contacting interface portion 27*b*. The contacting surface 76 is positioned along a lower surface of the lower contacting interface portion 27*b*.

In its simplest form, such pivot 78 allows the lower contacting interface portion 27*b* to rotate with respect to the upper contacting interface portion 27*a* of the kneepad 10 around an axis 80 which is substantially normal to the contacting surface 76. In this case, the pivot 78 can be a pin, a screw, a bearing assembly, a rotatable joint, or the like, in one of either of the upper contacting interface portion 27*a* and the lower contacting interface portion 27*b* of the kneepad 10, which engages the other. Both components can snap together or be more positively connected together, for example by a screw and nut. One skilled in the art will understand that, in alternative embodiments (not shown), the pivot 78 could also be positioned between different components of the kneepad 10 than those of the embodiment shown, such as, for example and without being limitative between the contacting interface 27 and the pad 26 of the body 20.

In an embodiment, the pivot 78 can be positioned in an upper portion of the lower contacting interface portion 27*b*, offset from and above the center of mass 82 of the lower contacting interface portion 27*b*. When the wearer is standing up, this advantageously makes the lower contacting interface portion 27*b* rotate back to a normal resting position where a length that is the longest dimension of the lower contacting interface portion 27*b* is substantially parallel with the leg of the wearer 16 and where the center of mass 82 of the lower contacting interface portion 27*b* is substantially horizontally aligned and positioned below the pivot 78. Hence, if the lower contacting interface portion 27*b* gets pivoted out of this stable equilibrium position, it will realign by itself as soon as the wearer 16 stands up and the friction force releases lower contacting interface portion 27*b*.

In FIG. 5, the wearer 16 is kneeled on both knees, both feet also resting on the inclined work surface 18, working on an area directly in front of him. The pivot 78, which provides one degree of freedom (rotation around the axis 80), further allows a maneuver as depicted in FIG. 6. In FIG. 6, for example in order to pick up a new shingle to be installed, the wearer 16 turns to his right. In doing so, he raises on his right leg, lifts his left foot, but safely retains his weight on his left knee on the inclined work surface 18. As can be seen, this is possible by having the lower contacting interface portion 27*b* retain the original orientation it had in FIG. 5, but by allowing a rotation of the pad 26 and the upper contacting interface portion 27*a* of the kneepad 10 with respect to the lower contacting interface portion 27*b*. Here the rotation is substantially 90 degrees, but it does not have to be limited. For example, the lower contacting interface portion 27*b* can be allowed to rotate by any angle. It could even be spun around the axis 80, but, as explained above, it will always advantageously regain its stable equilibrium or resting position when the wearer 16 stands up.

As can be observed in FIG. 6, because the wearer 16 did not lift his left knee from the inclined work surface 18, the pivot 78 allowed the lower contacting interface portion 27*b* to remain in its initial orientation depicted in FIG. 5. However, in doing so, the weight on the left leg of the wearer gets shifted sideways and is no longer applied directly over a center of mass of the body 20 of the kneepad 10, creating a torque which tends to flip the body 20 of the kneepad 10. The elongated shape (in the present case, a rectangular shape) of the lower contacting interface portion 27*b* contributes to prevent such unfortunate occurrence. Indeed, a lower portion 84 of the lower contacting interface portion 27*b* extends sufficiently downwardly from the body 20 of the kneepad 10, thereby preventing the body 20 of the kneepad 10 from flipping over. Providing added comfort to the wearer in such position, the higher inner bolster 36 located on the inner side of the wearer's left leg also provides added support to the wearer's left knee and leg.

It shall be appreciated that in the maneuver described above, the wearer 16 must lift his left foot in order to shift the left leg orientation without raising his left knee. This is made easier by having the parallelogram geometry described above as no undue strain is created on the lifted foot.

As depicted in many of the figures referred to in the present description, kneepads 10 are typically used in pairs. Hence, in another embodiment, a kit 86 comprising two kneepads 10 as described herein is provided. This kit 86 can comprise two identical kneepads 10. That would be the case if both the inner and the outer bolsters 36, 38 are of the same size. Alternatively, the kit 86 can comprise two different kneepads 10, as would typically be the case when the inner bolster 36 is higher than the outer bolster 38. Then, the two kneepads 10 provided in the kit 86 are mirror images of each other, that is there is a left kneepad designed to be worn on the left knee and a right kneepad designed to be worn on the right knee. The left kneepad has the larger inner bolster 36 on its right-hand side while the right kneepad has the larger inner bolster 36 on its left-hand side.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention could be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A kneepad adapted to be worn on a wearer's leg for working on an inclined work surface, the kneepad comprising:

a body positionable onto the inclined work surface and including:

a pad defining an open cavity for receiving a knee of the wearer, and a contacting interface being adapted to adhere to the inclined work surface and secured to the pad so as to be between the pad and the inclined work surface;

a leg connector connected to the body of the kneepad and securable to a knee region of the wearer's leg, the leg connector being adapted to abut the pad against the knee when the knee is received within the cavity of the pad; and a foot connector connected to the body of the kneepad and securable to a foot region of the wearer's leg, the foot connector having an upper connecting portion connected to the pad proximate to a knee portion of the open cavity, the foot connector also extending from the body of the kneepad to the foot region along the wearer's leg and allowing pivoting of the wearer's leg at the knee, at a pivot point positioned along an upper section of pad, when the knee is received within the cavity of the pad, wherein the foot connector is load-bearing to refrain the body from sliding up the wearer's leg by substantially more than a maximum length when a force is applied along the wearer's leg.

2. The kneepad of claim 1, wherein the foot connector comprises a length adjusting system for adjusting a length of the foot connector in accordance with a length of the wearer's leg.

3. The kneepad of claim 1, wherein the foot connector is flexible.

4. The kneepad of claim 1, wherein the foot connector comprises:

an upper connecting portion being secured to the body of the kneepad;

a lower connecting portion being reversibly securable to the foot region of the wearer's leg; and a length adjusting system interconnecting the upper connecting portion and the lower connecting portion, and being configured to adjust a length of the foot connector in accordance with a length of the wearer's leg.

5. The kneepad of claim 4, wherein the lower connecting portion of the foot connector is frictionally engaged with a proximal surface of the foot region.

6. The kneepad of claim 5, wherein the foot region is a foot member of the wearer's leg, and the proximal surface of the foot region is a bottom surface of the foot member with lower connecting portion being at least partially positioned inside a footwear of the wearer.

7. The kneepad of claim 5, wherein the foot region is a footwear of the wearer, and the proximal surface of the foot region is a bottom surface of the footwear.

8. The kneepad of claim 4, wherein the upper connecting portion of the foot connector is frictionally engaged with a distal surface of the pad.

9. The kneepad of claim 8, wherein the body further comprises at least one hook component extending outwardly from the distal surface of the pad, the hook component being shaped to receive and retain the upper connecting portion of the foot connector, thereby preventing any sliding thereof from the pad.

10. The kneepad of claim 4, wherein the upper connecting portion and the lower connecting portion are portions of a same strap member forming a loop around the wearer's leg when the knee is received within the cavity of the pad.

11. The kneepad of claim 4, wherein the foot connector further comprises at least one connecting assembly comprising a hook and a ring, with the hook being provided at an end of the upper connecting portion so as to engage the ring being provided at an end of the lower connecting portion.

12. The kneepad of claim 4, wherein the upper connecting portion is connected to the contacting interface of the kneepad at at least one upper pivot point.

13. The kneepad of claim 1, wherein the foot connector comprises one of a strap, a chain, a cable and a rope.

14. The kneepad of claim 1, wherein the contacting interface comprises:

a rigid portion extending at least inwardly and outwardly from the pad to define respectively an inner edge portion and an outer edge portion of the contacting interface, and a contacting portion being applied to the rigid portion and being positionable to contact the inclined work surface, wherein the contacting portion is made of a resilient material that is selected to at least partially conform to a shape of the inclined work surface when loaded with at least a portion of a weight of the wearer so as to generate a friction force against the inclined work surface, the friction force having a vertical component at least partially sufficient to retain the wearer on the inclined work surface.

15. The kneepad of claim 14, wherein the contacting portion is substantially flat.

16. The kneepad of claim 14, wherein the rigid portion and the pad of the body are formed as a single-piece structure.

17. The kneepad of claim 14, wherein the inner edge portion has a width that is larger than a width of the outer edge portion to provide an increased friction force when the kneepad is perpendicular to the roof.

18. The kneepad of claim 1, wherein the pad comprises an inner bolster defining an inner side of the open cavity and an outer bolster defining an outer side of the open cavity, the inner bolster being higher than the outer bolster, with the inner bolster being sized and shaped to abut an interior portion of the wearer's leg.

19. The kneepad of claim 18, wherein the pad further comprises a distal bolster defining a distal side of the open cavity, the distal bolster being sized and shaped to abut another leg portion above the knee.

20. A kneepad kit comprising a pair of kneepads as defined in claim 1, the pair of kneepads comprising a left kneepad and a right kneepad, the left kneepad being a mirror image of the right kneepad.

* * * * *